US005129819A

United States Patent [19]

Rubin

[11] Patent Number: 5,129,819

[45] Date of Patent: Jul. 14, 1992

[54] CIGARETTE LIGHTER

[76] Inventor: Boris Rubin, 35-53 77 St., Jackson Hts., N.Y. 11372

[21] Appl. No.: 632,978

[22] Filed: Dec. 24, 1990

[51] Int. Cl.[5] ..... F23Q 2/36

[52] U.S. Cl. ..... 431/124; 431/129; 431/139; 431/276

[58] Field of Search ..... 431/124, 129-144, 431/344, 142, 143, 276

[56] References Cited

U.S. PATENT DOCUMENTS

| | | | |
|---|---|---|---|
| 2,162,345 | 6/1939 | Goldberger | 431/129 |
| 2,501,841 | 3/1950 | Burchett | 431/276 |
| 2,536,855 | 1/1951 | Pearcy, Jr. | 431/139 |
| 2,957,328 | 10/1960 | Gellman | 431/130 |

FOREIGN PATENT DOCUMENTS

| | | | |
|---|---|---|---|
| 1045695 | 7/1953 | Fed. Rep. of Germany | 431/138 |

*Primary Examiner*—James C. Yeung

[57] ABSTRACT

A cigarette lighter comprises a housing bounding an inner space, and an actuating unit accommodated in the space and including a push-button, a lever mechanism connected with the push-button, a strike flint, a striking wheel connected with the lever mechanism, and a hood also connected with the lever mechanism, the lever mechanism being formed so that the hood opens for releasing a space for a flame and the striking wheel is turned for striking against the flint by different angles.

9 Claims, 2 Drawing Sheets

CIGARETTE LIGHTER

BACKGROUND OF THE INVENTION

The invention relates to cigarette lighters, and more particularly to such cigarette lighters which have a flint and a striking wheel cooperating with the flint for generating a spark.

Cigarette lighters of the above mentioned general type are known in the art. In a known cigarette lighter the striking wheel and a hood for extinguishing a flame are connected with a drive such that the striking wheel and the hood are turned during the actuation of the cigarette lighter by the same angle. This has the disadvantage that when the hood is to be opened by 90°, the striking wheel also turns by only 90° and therefore the angle of turning is not big enough to insure sufficient time for producing a spark, so that there is a risk of malfunction. Also, in the known cigarette lighters there is no automatic supply of flints upon wearing of the preceding flint and the mechanism cannot be observed from outside.

SUMMARY OF THE INVENTION

Accordingly, it is an object of the present invention to provide a cigarette lighter which avoids the disadvantages of the prior art.

More particularly, it is an object of the present invention to provide a cigarette lighter in which a drive for a hood and for a striking wheel is designed so that these elements are turnable by different angles.

For example when the hood is turned in the new cigarette lighter by 90° only, the striking wheel can turn for example by 120° so as to increase the area of striking and therefore to reduce the risk of malfunction of spark.

In accordance with another feature of the present invention, the cigarette lighter has a magazine and means for automatically supplying the flints from the magazine to a position in which they cooperate with the striking wheel.

Finally, the cigarette lighter is provided with an observation window closed by a transparent element such as a glass so that the mechanism can be observed from outside.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
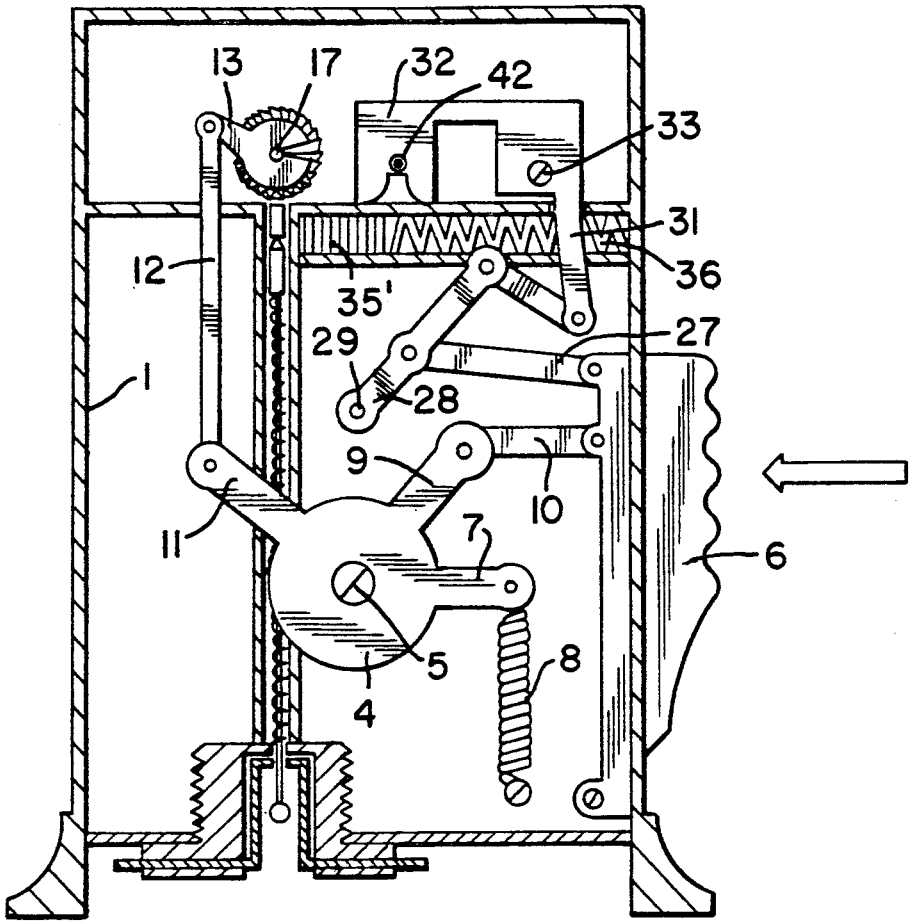
FIG. 1 is a sectional side view of a cigarette lighter in accordance with the present invention.
Figure 4:
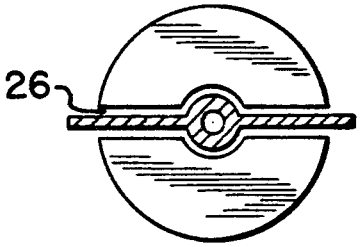
FIG. 4 is a view from below showing a screw in the bottom of the cigarette lighter.
Figure 3:
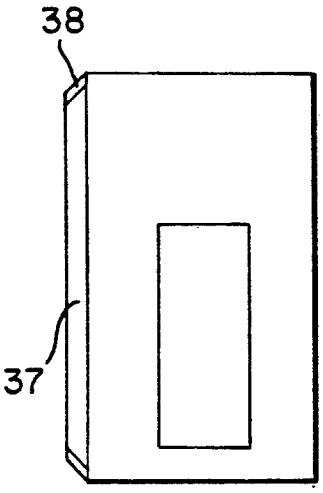
FIG. 3 is a top view of the cigarette lighter.

A cigarette lighter in accordance with the present invention has a housing which is identified as a whole with reference numeral 1. The housing is subdivided into a chamber 2 for accommodating an operating mechanism of the cigarette lighter and a chamber 3 for accommodating a cotton soaked with an inflammable substance.

The mechanism accommodated in the chamber 2 includes a spider-like element 4 which is turnable on an axle 5 formed as a screw and fixedly connected with the housing. A push-button 6 is movable in direction identified with the arrow in FIG. 1. A leg 7 of the spider-like element 4 is connected with a spring 8 which in turn is connected with the push-button 6 to turn the spider-like element to its initial position. Another leg 9 is turnably connected with a link 10, while a further leg 11 is turnably connected with a rod 12. The rod 12 is turnably connected with a lever 13 which cooperates with a striking wheel 14. The striking wheel 14 has a plurality of saw-tooth shaped formations 15 which cooperate with a slot 16 of the lever 13 as well known in the art. The striking wheel is turnable about an axle 17 fixed in the housing. Flint 18 cooperates with the striking wheel 14 and is pushed toward the latter by a pusher 19 which in turn is spring-biased by a spring 20. The pusher is connected by a wire bar 21 with a ball 22. The bar 21 extends through an opening in a hollow nut 23 and another opening in a shaped member 24 which has lateral projections 25. The lateral projections 25 are slidable in slots 26 provided in the nut 23. The upper part of the push button 6 is connected through a link 27 with a lever 28. One end of the lever 28 is turnable about an axle 29 which is formed as a screw fixed in the housing, while the other end of the lever 28 is pivotally connected with a link 30 which is then pivotally connected with a link 31. The link 31 is connected with a hood 32 which is pivotable about an axis 33 fixed in the housing. The chamber 2 is provided with a receptacle 34 which is formed as a narrow slot and accommodates a plurality of extra flints 35 and a spring 36. The left wall of the receptacle 34 has a narrow horizontal slot 35 which extends over the whole length of the receptacle 34 or in other words over the whole length of the extra flints 35 and the spring 36. The receptacle 34 forms a magazine for storing and then automatically pushing the flints as will be explained hereinbelow.

Figure 2:
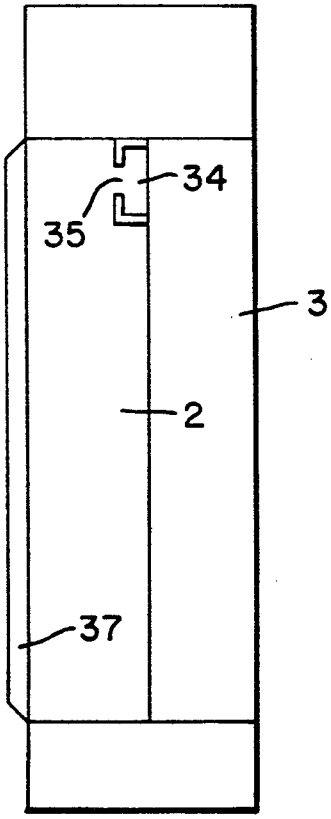
FIG. 2 is an end view of the cigarette lighter.
Figure 5:
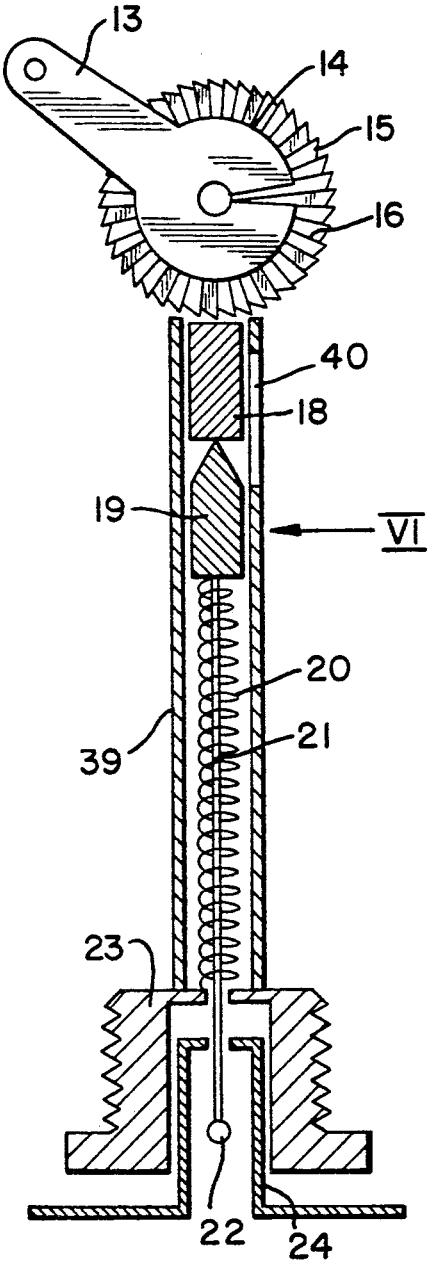
FIG. 5 is an enlarged side view of a striking wheel-flint unit.
Figure 6:
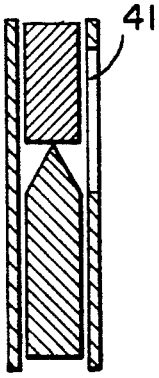
FIG. 6 is a partial view as seen in direction of the arrow 6 in FIG. 5.

The left end of the chamber 2 shown in FIG. 2 has a window which is closed by a glass 37. The glass 37 slides in guides 38 provided in the walls of the housing 1. A pipe 39 in which the flint 18, the pusher 19, the spring 20 and the rod 21 are accommodated has a window 40 for moving extra flints into the area inside the tube 39, to bring a next flint into contact with the striking wheel. On the other hand, the tube 39 has a window in its front wall and is identified with reference numeral 41 on FIG. 6.

The cigarette lighter according to the present invention operates in the following manner:

When it is necessary to generate a flame, the pushbutton 6 is pressed by a user in direction of the arrow in FIG. 1, the lever mechanism is activated, the hood 32 is turned by 90° so as to release a flame producing element 42, while the striking wheel turns by approximately 120°, strikes the flint and produces a spark which ignites the inflammable substance (gasoline) so that a flame is generated in the element 42. When then the button is released, the spring 8 moves the mechanism toward its initial position. When a flint in the position immediately underneath the striking wheel is worn out, a next flint is pushed from the magazine 34 by the spring 36 to the position of the previous flint, thus automatically resuming the operation of the cigarette lighter. The position of the flints and the spring can be seen through the slot 34. The glass 37 permits observation of the mechanism as a whole during its operation. The window 41 permits observation of the flint and the degree of its wear in the position of the pusher 19. In order to permit pushing of the next flint to the working position, the element 24 is pulled downwardly by its parts 25 to release the space above the pusher. The oppositely bent member 25 can also be used as an additional lever for unscrewing the screw 23. By grasping the member 25 and turning it around the vertical axis, the screw 23 can be unscrewed for servicing of the flint pushing system.

The receptacle 34 is formed as a vertical slot with a height corresponding to the height of the flints and the spring and a width corresponding to the width of the flint and the spring so as to guide the flint and the spring. The spring is therefore formed as a metal band which is bent so as to form the spring.

The present invention is not limited to the details shown, since various modifications and structural changes are possible without departing in any way from the spirit of the present invention.

What is desired to be protected and claimed by Letters Patent is set forth in particular in the appended claims.

1. A cigarette lighter, comprising a housing bounding an inner space; an actuating mechanism accommodated in said space and including a push-button, a lever mechanism connected with said push-button, a strike flint, a striking wheel connected with said lever mechanism, and a hood also connected with said lever mechanism, said lever mechanism being formed so that said hood opens for releasing a space for a flame and said striking wheel is turned for striking against said flint by different angles, housing having a bottom provided with an opening; a screw which closes and opens said opening; and means for advancing said flint toward said striking wheel and including a pusher cooperating with said flint, a spring biasing said pusher toward said flint, a rod connected with said pusher and provided with an end formation, and a shaped member arranged on said rod so as to pull the rod to withdraw said pusher from said flint, said screw having slots so that said shaped member can slide in said slots and also serve as a tool for turning said screw.

2. A cigarette lighter as defined in claim 1; and further comprising a magazine accommodated in said housing and formed to store a plurality of additional flints; and further comprising flint confining means for accommodating a flint in its position adjacent to the striking wheel so as to be stricken by said striking wheel and means for communicating; said magazine with said flint confining means so as to allow movement of one of said additional flints into said flint confining means upon wearing of said first mentioned flint.

3. A cigarette lighter as defined in claim 2; and further comprising a spring arranged in said magazine and formed to spring bias said additional flint toward said flint confining means.

4. A cigarette lighter as defined in claim 2, and wherein said magazine is formed as a substantially rectangular receptacle extending in a vertical direction and having a transverse dimension corresponding to a thickness of said additional flints.

5. A cigarette lighter as defined in claim 4, wherein said receptacle has a horizontal slot extending over a whole length of said receptacle so as to provide a possibility of observing said first mentioned flint and said additional flints and said spring.

6. A cigarette lighter as defined in claim 1, wherein said housing has a window; and further comprising a transparent element closing said window so that said actuating mechanism can be seen through said transparent element.

7. A cigarette lighter as defined in claim 1; and further comprising means for urging said flint toward said striking wheel and including a guide, a pusher accommodated in said guide, and a spring spring biasing said pusher toward said flint.

8. A cigarette lighter as defined in claim 7, wherein said guide has a window for observing a position of said flint and said pusher.

9. A cigarette lighter as defined in claim 7, wherein said guide has a slot for introducing a next one of said additional flints into said flint confining means through said slot.

* * * * *